US007500667B2

(12) United States Patent
Miyazaki et al.

(10) Patent No.: US 7,500,667 B2
(45) Date of Patent: Mar. 10, 2009

(54) POST-PROCESSING APPARATUS

(75) Inventors: Masahiko Miyazaki, Osaka (JP); Takeshi Matsuo, Osaka (JP)

(73) Assignee: Kyocera Mita Corporation (JP)

( * ) Notice: Subject to any disclaimer, the term of this patent is extended or adjusted under 35 U.S.C. 154(b) by 246 days.

(21) Appl. No.: 11/493,293

(22) Filed: Jul. 25, 2006

(65) Prior Publication Data

US 2007/0024000 A1 Feb. 1, 2007

(30) Foreign Application Priority Data

Jul. 26, 2005 (JP) ..... 2005-215872

(51) Int. Cl.
*B65H 29/34* (2006.01)

(52) U.S. Cl. ..... 271/189; 270/58.08

(58) Field of Classification Search ..... 271/298, 271/189; 270/58.12, 58.08, 58.11, 58.13
See application file for complete search history.

(56) References Cited

U.S. PATENT DOCUMENTS 7,243,913 B2 * 7/2007 Terao et al. ..... 270/58.08

FOREIGN PATENT DOCUMENTS

JP 2002-128382 5/2002

* cited by examiner

*Primary Examiner*—Kaitlin S Joerger
(74) *Attorney, Agent, or Firm*—Gerald E. Hespos; Anthony J. Casella

(57) ABSTRACT

A post-processing apparatus is for applying a specified post-processing to sheets supplied from an image forming apparatus and includes an apparatus main body, a first tray disposed in the apparatus main body for applying the specified post-processing to a bunch of sheets formed by storing a specified number of sheets supplied from the image forming apparatus one over another and then discharging the processed bunch of sheets, and a second tray disposed in the apparatus main body for directing the sheets supplied from the image forming apparatus toward the first tray after detouring the sheets. The first and second trays are integrally insertable into and withdrawable from the apparatus main body.

7 Claims, 6 Drawing Sheets

POST-PROCESSING APPARATUS

BACKGROUND OF THE INVENTION

1. Field of the Invention

The present invention relates to a post-processing apparatus for applying a specified post-processing to sheets fed from an image forming apparatus such as a copier, a facsimile apparatus or a printer.

2. Description of the Related Art

There have been known post-processing apparatuses as disclosed in Japanese Unexamined Patent Publication No. 2002-128382. This post-processing apparatus is for applying punching to perforate binding holes in sheets fed from an image forming apparatus, and stapling to bind a stored bundle of sheets. Such a post-processing apparatus has a punching machine, a staple tray, a standby drum and a switching guide built in an apparatus main body. The punching machine is disposed at an intermediate position on a receiving conveyance path for receiving a sheet from the image forming apparatus to apply punching to the sheet. The staple tray is disposed below the receiving conveyance path to form a bundle of sheets by temporarily storing the sheets fed from a downstream end of the receiving conveyance path and to apply stapling to this bundle of sheets. The standby drum is disposed above the downstream end of the receiving conveyance path to temporarily store sheets to constitute a next bundle of sheets while stapling is applied to the previous bundle of sheets on the staple tray. This standby drum stores sheets on its outer circumferential surface. The switching guide is disposed at the downstream end of the receiving conveyance path to switch a conveyance end of the sheet between the staple tray and the standby drum.

The standby drum is disposed at such a position as to enable an operation of temporarily storing the next sheets while the previous bunch of sheets is temporarily stored on the staple tray to be stapled, and supplying the sheets kept on standby to the staple tray after the previous bunch of sheets was discharged after the completion of stapling. This operation enables conveyance intervals of the sheets fed from the image forming apparatus to be kept constant, thereby making the image forming operation including the post-processing more efficient.

The staple tray is comprised of a lower tray obliquely disposed in the apparatus main body and an upper tray disposed to face the upper surface of the lower tray. A storage space for storing the sheets is defined between these upper and lower trays. Stapling is applied to the bunch of sheets stored in this storage space by means of a stapler, and the thus obtained bound bunch of sheets is discharged from the storage space toward a discharge tray located outside.

In order to easily solve a problem of a paper jam during the stapling, the staple tray is made withdrawal from the apparatus main body in a sheet-width direction normal to a sheet conveying direction. The upper tray in a withdrawn state is pivotal about a specified position at the bottom end of the lower tray to open up the clearance. Accordingly, when a paper jam occurs, an operator can expose a jammed position to the outside by opening the upper tray, wherefore the paper jam can be easily solved.

In the post-processing apparatus disclosed in Japanese Unexamined Patent Publication No. 2002-128382, the standby drum for temporarily keeping the sheets on standby is disposed above the receiving conveyance path. In order to temporarily store the sheets by letting the sheets wind around the outer circumferential surface of the standby drum, a considerably large diameter needs to be set for the standby drum. If such a standby drum is disposed at an upper part of the apparatus main body, there arises a problem of increasing the height of the apparatus main body and hindering the post-processing apparatus from being made smaller.

SUMMARY OF THE INVENTION

An object of the present invention is to provide a post-processing apparatus provided with a function of temporarily keeping sheets on standby and enabling an operator to easily solve a paper jam problem while enabling an apparatus main body to be made smaller.

In order to accomplish the above object, the present invention is directed to a post-processing apparatus for applying a specified post-processing to sheets supplied from an image forming apparatus, comprising: an apparatus main body, a first tray disposed in the apparatus main body for applying the specified post-processing to bunch of sheets formed by storing a specified number of sheets supplied from the image forming apparatus one over another, and then discharging the processed bunch of sheets, and a second tray disposed in the apparatus main body for directing the sheets supplied from the image forming apparatus toward the first tray after detouring the sheets, the first and second trays being integrally insertable into and withdrawable from the apparatus main body.

With this construction, the apparatus main body can be made smaller as compared to a post-processing apparatus in which a conventional standby drum is disposed at a position above the first tray. Further, since the first and second trays are integrally insertable into and withdrawable from the apparatus main body, both trays can be integrally withdrawn by withdrawing either one of the first and second trays from the apparatus main body upon an occurrence of a paper jam in the first or second tray. Thus, as compared to a case where the first and second trays are individually withdrawn, the respective trays can be more easily withdrawn.

These and other objects, features, aspects and advantages of the present invention will become more apparent upon a reading of the following detailed description and accompanying drawings.

DESCRIPTION OF THE PREFERRED EMBODIMENTS

Hereinafter, one embodiment of the present invention is described with reference to the accompanying drawings.

Figure 1:
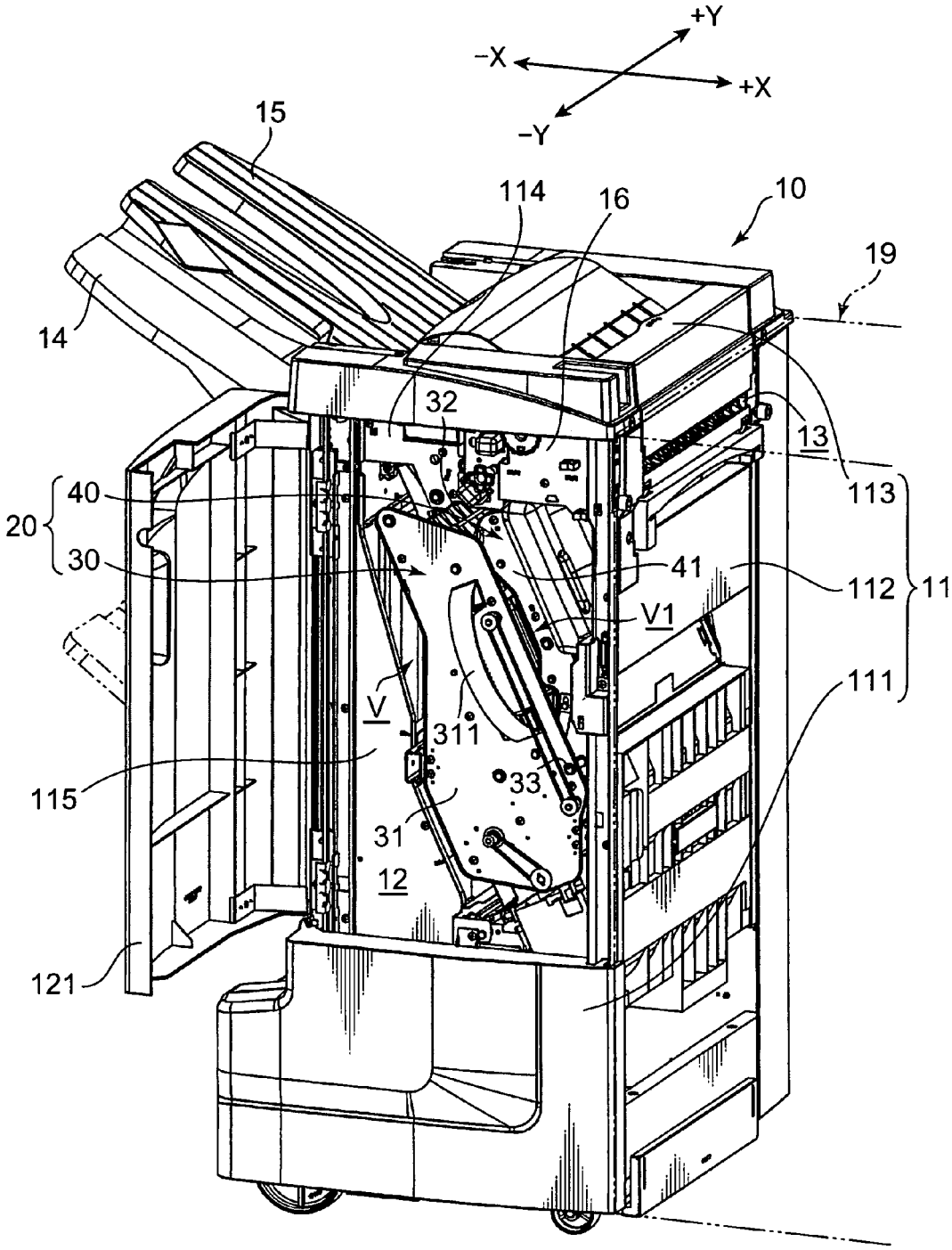
FIG. 1 is a perspective view showing the external appearance of one embodiment of a post-processing apparatus according to the invention in a state where a staple tray is accommodated in an apparatus main body.
Figure 2:
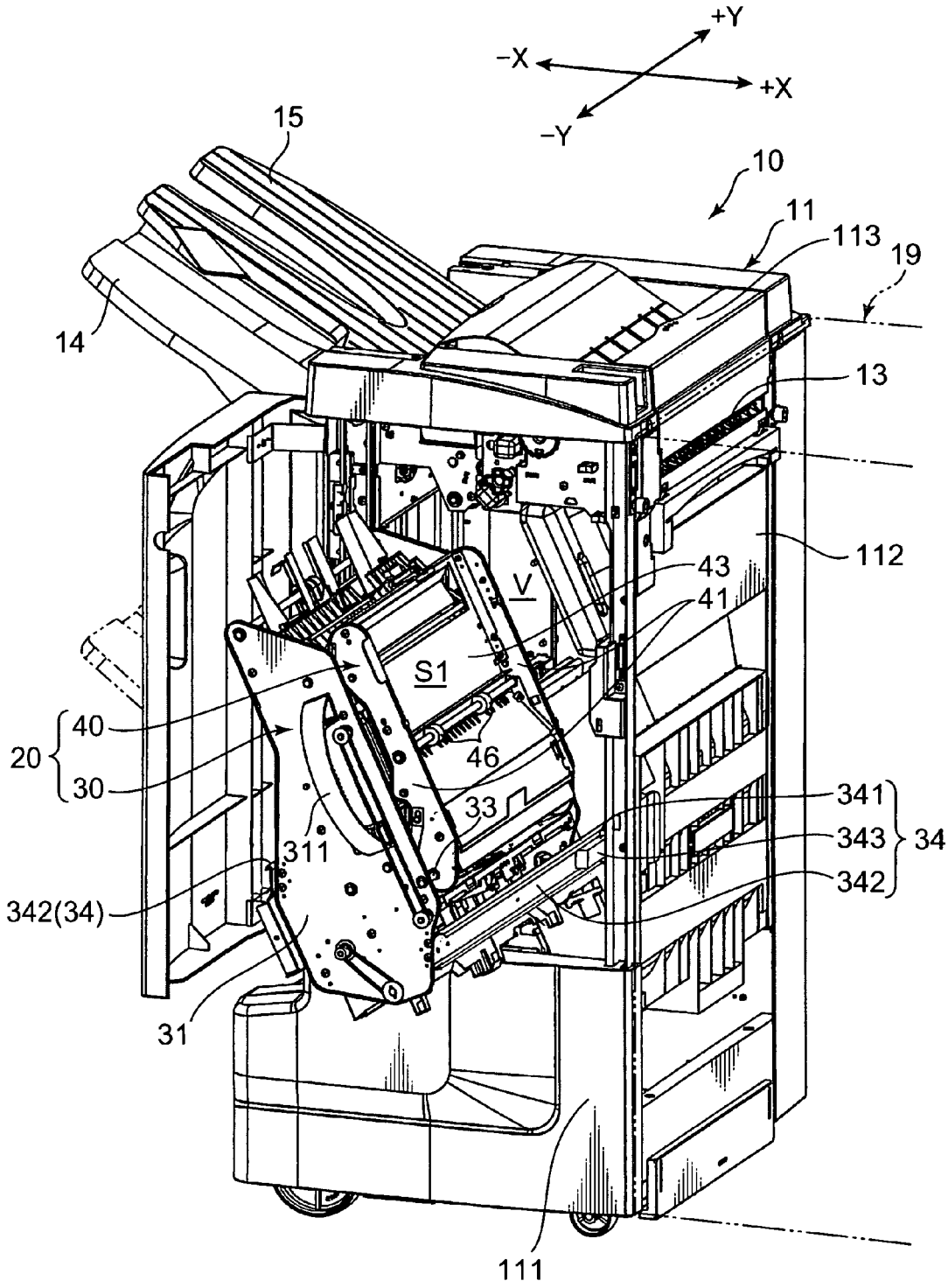
FIG. 2 is a perspective view showing the external appearance of the embodiment of the post-processing apparatus according to the invention in a state where the staple tray is withdrawn from an apparatus main body.
Figure 3:
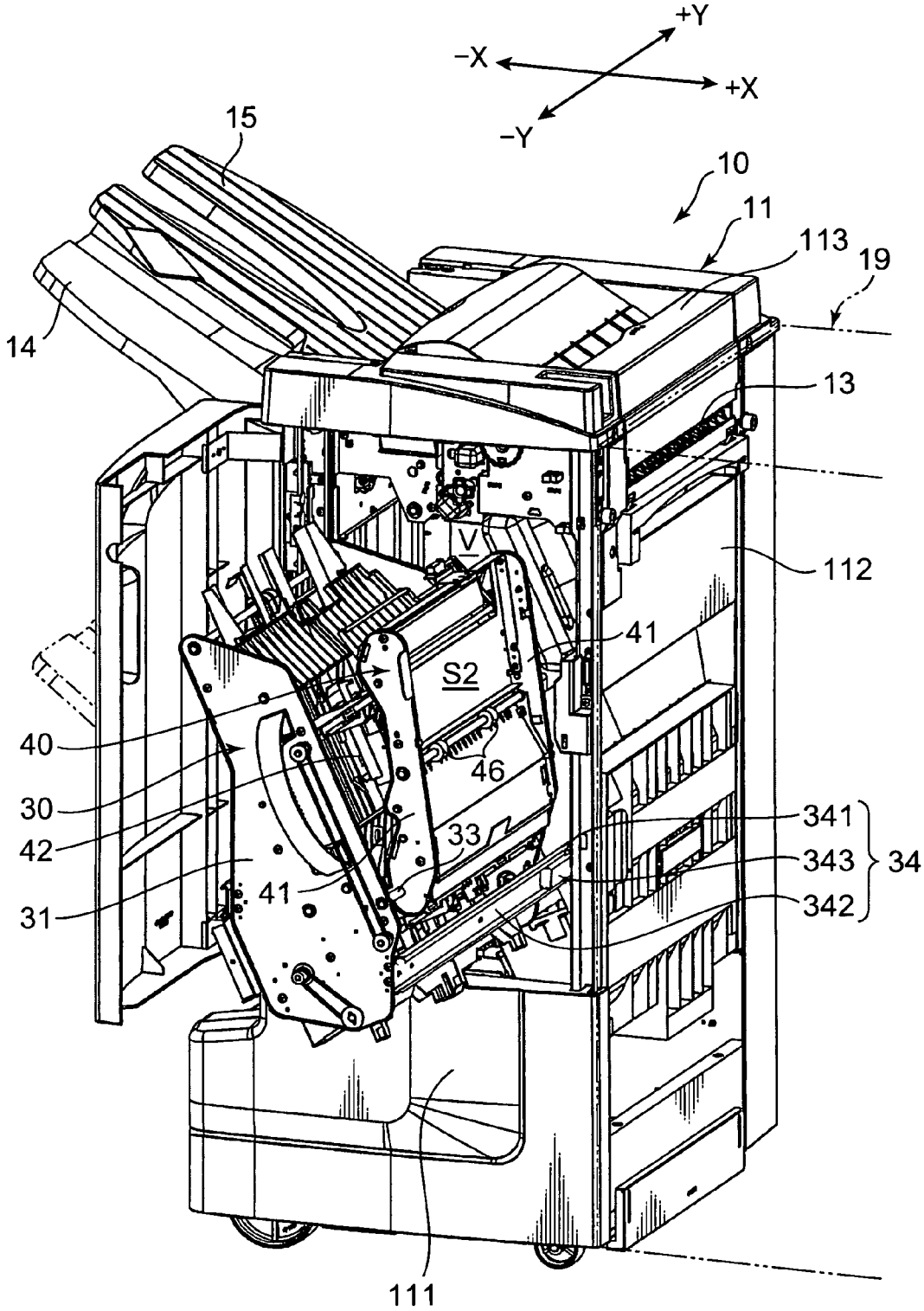
FIG. 3 is a perspective view showing the external appearance of the embodiment of the post-processing apparatus according to the invention in a state where a detour tray of the staple tray withdrawn from the apparatus main body is opened.

First, the external appearance of a post-processing apparatus 10 according to the present invention is described. FIGS. 1 to 3 are perspective views showing one embodiment of the post-processing apparatus according to the present invention, wherein FIG. 1 shows a state where a staple tray is accommodated in an apparatus main body, FIG. 2 shows a state where the staple tray is withdrawn from the apparatus main body and FIG. 3 shows a state where a detour tray of the staple tray withdrawn from the apparatus main body is opened. It should be noted that, in FIGS. 1 to 3, X-X directions are referred to as transverse directions and Y-Y directions are referred to as forward and backward directions, particularly −X direction being leftward direction, +X direction being right ward direction, −Y direction being forward direction and +Y direction being backward direction.

As shown in FIGS. 1 to 3, the post-processing apparatus 10 has a box-shaped external appearance and is in the form of a rectangular parallelepiped by including a front plate 111 standing from the front edge of an unillustrated bottom plate, a right plate member 112 standing from the right edge of the bottom plate, an unillustrated rear plate standing from the rear edge of edge of the bottom plate, an unillustrated left plate standing from the left edge of the bottom plate, and a ceiling plate member 113 disposed to cover the upper edges of the front plate 111, the right plate member 112, the left plate and the rear plate.

The height of the front plate 111 from the bottom plate is set to be substantially ⅓ of the height of the post-processing apparatus 10. An accommodation space V for accommodating a staple tray 20 is defined above the front plate 111, and a front door 121 for opening and closing this accommodation space V is provided. FIGS. 1 to 3 show a state where the front door 121 is opened.

A sheet receiving opening 13 for receiving a sheet P (see FIG. 4) fed from an image forming apparatus 19 is defined above the right plate member 112. The post-processing apparatus 10 applies punching for perforating binding holes in the sheet P introduced into the post-processing apparatus 10 through this sheet receiving opening 13, stapling for binding a bunch of sheets P1 (see FIG. 4) and the like.

A main tray 14 is disposed on the left surface of the post-processing apparatus 10, and an auxiliary tray 15 is disposed at the left side of the ceiling plate member 113. The main tray 14 is for receiving the stapled bunch of sheets P1 (see FIG. 4) and is movable upward and downward by being driven by means of specified elevating means. As more bunches of sheets P sheets P are discharged, the main tray 14 is successively lowered from an uppermost position. Contrary to this, the auxiliary tray 15 is for receiving sheets discharged without particularly having any post-processing applied thereto or those having only binding holes punched.

A punch unit 16 for perforating binding holes in the sheet P is so disposed at a position above an entrance conveyance path R1 at an upper right side in the post-processing apparatus 10 as to face the entrance conveyance path R1. An upper frame plate 114 supporting various rollers is so disposed at the left side of this punch unit 16 as to face the front opening of the accommodation space V. Below this upper frame plate 114 and at the left side in the post-processing apparatus 10, a triangular frame plate 115 having a substantially triangular shape is disposed to face the front opening of the accommodation space V. The hypotenuse of this triangular frame plate 115 is inclined down from an upper left side toward the right side in the post-processing apparatus 10.

The staple tray 20 applies stapling to the formed bunch of sheets P1 by means of a staple after temporarily storing a specified number of sheets fed from the image forming apparatus 19. The staple tray 20 is comprised of an intermediate tray (first tray) 30 obliquely disposed immediately at the right side of the triangular frame plate 115 and a detour tray (second tray) 40 attached to the intermediate tray 30 in such a manner as to as to extend along an oblique surface of the intermediate tray 30 at the right side.

The intermediate tray 30 includes a pair of front and rear first frame plates 31 and an intermediate-tray main body 32 (see FIG. 5) obliquely disposed between these first frame plates 31. On the other hand, the detour tray 40 includes a pair of front and rear second frame plates 41 and a detour-tray main body 42 (see FIG. 5) disposed in parallel with the intermediate-tray main body 32 between these second frame plates 41.

A coupling shaft 33 is mounted between the first frame plates 31 at a specified position of a lower right part of the intermediate tray 30. The detour tray 40 is rotatable in forward and reverse directions about the coupling shaft 33 by the coupling shaft 33 penetrating the bottom ends of the second frame plates 41. The detour-tray main body 42 is displaceable between a closing posture S1 shown in FIG. 2 where the intermediate-tray main body 32 is closed and an opening posture S2 shown in FIG. 3 where the intermediate-tray main body 32 is opened.

A storage space V1 in the form of a specified clearance for storing sheets P is defined between the intermediate-tray main body 32 and detour-tray main body 42. Stapling is applied to the bunch of sheets P1 formed by successively feeding a specified number of sheets P into this storage space V1.

Upon an occurrence of a paper jam in the storage space V1 of the staple tray 20, the staple tray 20 is withdrawn from the accommodation space V of the post-processing apparatus 10 (see FIG. 2), and the detour tray 40 is manually displaced from the closing posture S1 (see FIG. 2) to the opening posture S2 (see FIG. 3) by an operator in this state. Since the jammed sheet P is thus exposed to the outside, the operator can easily remove the jammed sheet P.

In this embodiment, the staple tray 20 is insertable into and withdrawable from the accommodation space V of the post-processing apparatus 10 by being guided by a pair of left and right guiding members 34 disposed slightly below a vertical middle part of the intermediate tray 30. Each guiding member 34 is comprised of a fixed rail 341 fixed to the inner surface of the right plate member 112 or the left plate member and extending in forward and backward directions, a movable rail 342 fixed to the intermediate tray 30 in such a manner as to face the fixed rail 341, and a retainer 343 arranged between the fixed rail 341 and the movable rail 342.

With such guiding members 34, the movable rails 342 are moved in forward and reverse directions while being guided along the fixed rails 341 via the retainers 343 moving between the fixing rails 341 and the movable rails 342 by inserting and withdrawing the intermediate tray 30 into and from the accommodation space V of the post-processing apparatus 10. Thus, the intermediate tray 30 is smoothly withdrawn from or inserted inserted into the accommodating space V.

A grip band 311 made of a flexible material such as a synthetic resin sheet is provided at a specified position of the front first frame plate 31. The operator can withdraw the staple tray 20 (see FIG. 1) accommodated in the accommodation space V to the outside by holding and pulling this grip band 311 forward (see FIG. 2).

Figure 4:
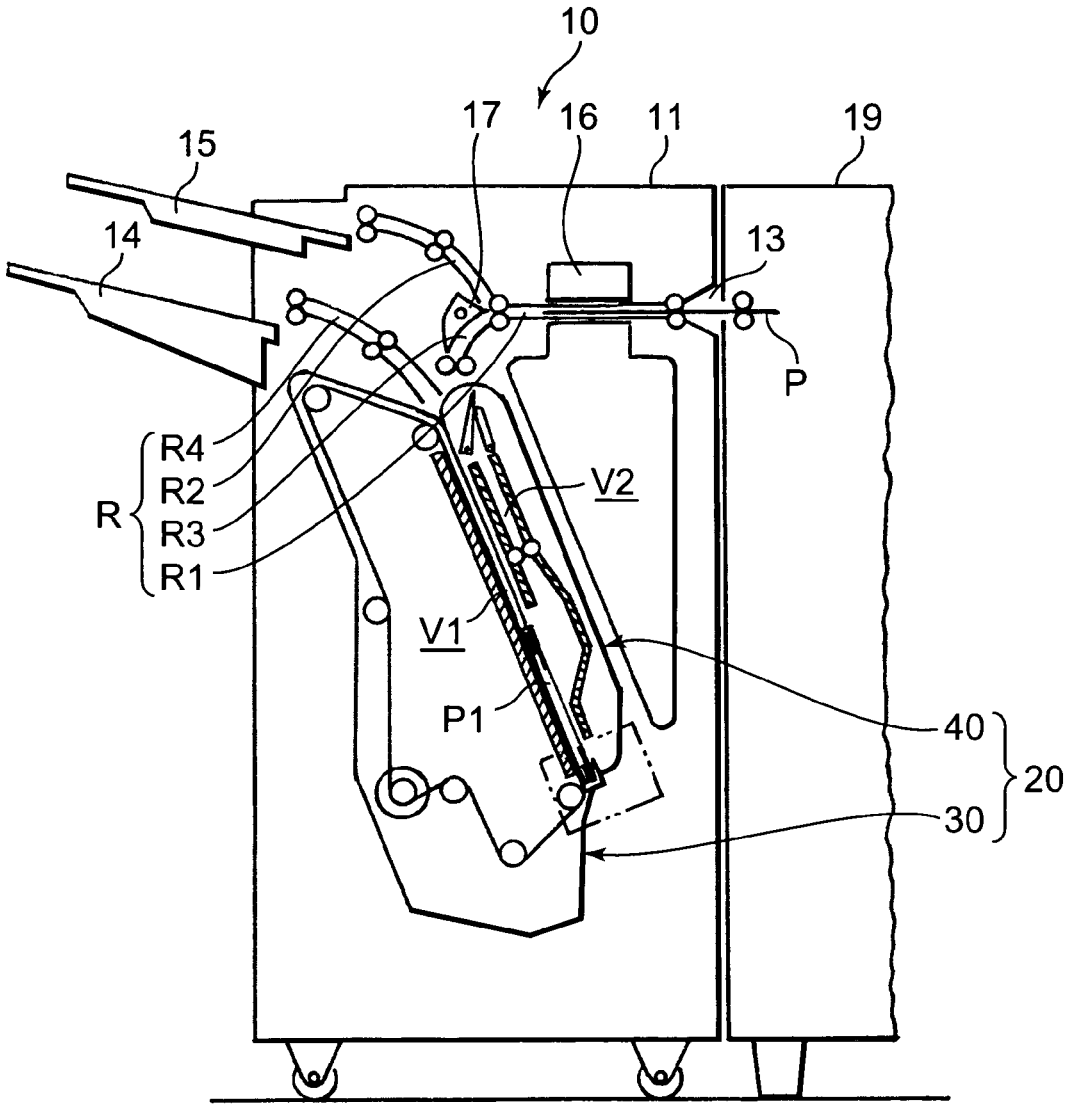
FIG. 4 is a front view in section showing one embodiment of the internal construction of the post-processing apparatus according to the invention.

Next, the internal construction of the post-processing apparatus 10 is described. FIG. 4 is a front view in section showing one embodiment of the internal construction of the post-processing apparatus 10 according to the present invention. As shown in FIG. 4, sheet conveyance paths R for conveying the sheet P fed from the image forming apparatus 19 to the respective locations depending on the purpose are formed in the post-processing apparatus 10.

The sheet conveyance paths R include the entrance conveyance path R1 extending leftward from the sheet receiving opening 13 of the post-processing apparatus 10 to a substantially transverse middle position of the post-processing apparatus 10, an auxiliary-tray conveyance path R2 branched off from the downstream end of the entrance conveyance path R1 and extending toward the auxiliary tray 15, a storage-space conveyance path R3 branched off from the downstream end of the entrance conveyance path R1 and extending toward the storage space V1 of the staple tray 20, and a main-tray conveyance path R4 extending toward the R4 extending toward the main tray 14 from the upper end of the storage space V1.

The punch unit 16 is disposed at the position above the entrance conveyance path R1. The sheet P introduced into the entrance conveyance path R1 through the sheet receiving opening 13 is temporarily stopped and has binding holes punched at specified positions through punching by driving the punch unit 16.

A switching guide 17 for switching a conveyance end of the sheet P between the auxiliary-tray conveyance path R2 and the storage-space conveyance path R3 is disposed at the downstream end of the entrance conveyance path R1. If no stapling is applied to the sheet P, the sheet P is discharged onto the auxiliary tray 15 via the auxiliary-tray conveyance path R2 with the switching guide 17 set in a specified posture. On the other hand, if stapling is to be applied to the sheet P, the sheet P is fed to the staple tray 20 via the storage-space conveyance path R3 by changing the posture of the switching guide 17. When a specified number of sheets P are stored in the storage space V1 to form a bunch of sheets P1, stapling is applied to this bunch of sheets P1. The stapled bunch of sheets P1 is discharged onto the main tray 14 via the main-tray conveyance path R4.

Figure 5:
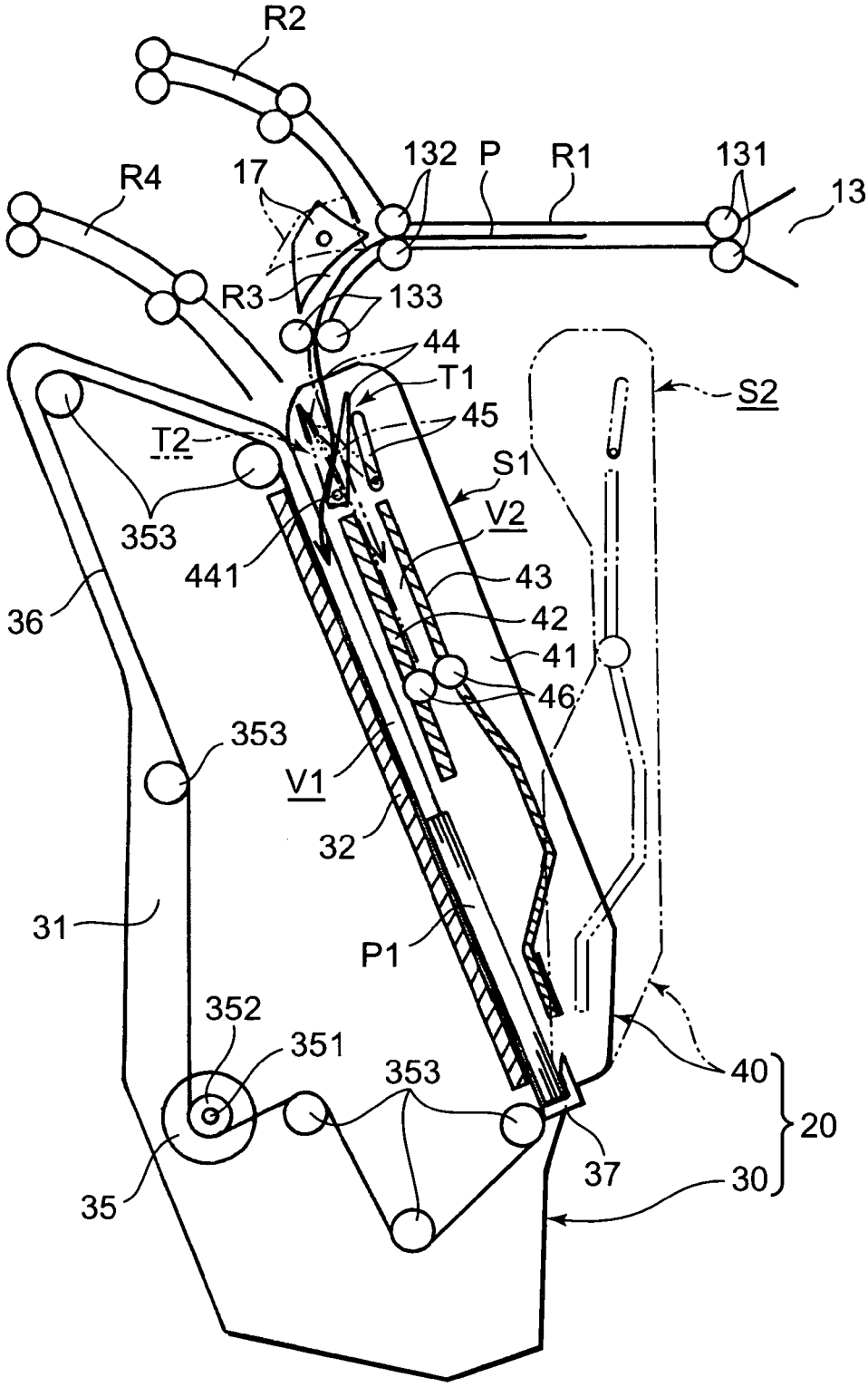
FIG. 5 is a partial enlarged view of FIG. 4 showing a schematic construction of the staple tray.

Hereinafter, the schematic construction of the staple tray 20 is described with reference to FIG. 5 and, if necessary, also to FIGS. 1 to 4. FIG. 5 is a partial enlarged view of FIG. 4 showing the schematic construction of the staple tray 20. As shown in FIG. 5, a motor 35 for a belt is disposed at specified positions of a pair of front and rear first frame plates 31 (facing in a direction normal to the plane of FIG. 5) of the intermediate tray 30 as a component of the staple tray 20 such that a drive shaft 351 extends in forward and backward directions. A drive roller 352 is so mounted on the drive shaft 351 as to be rotatable together. Driven rollers 353 whose driven shafts are mounted between the pair of first frame plates 31 are disposed at an upper end position, a bottom end position and specified positions of the intermediate-tray main body 32. An endless belt 36 for moving the staple tray 20 upward and downward is mounted on the drive roller 352 and the respective driven rollers 353.

A sheet receiving member 37 L-shaped in front view is provided on the front surface of the endless belt 36 to receive the bunch of sheets P1 in the storage space V1 and move it upward and downward. An unillustrated stapler for applying stapling to the bunch of sheets P1 is disposed at a position corresponding to the bottom end of the intermediate-tray main body 32. This stapler applies stapling to this bunch of sheets P1 with the bunch of sheets P1 supported on the sheet receiving member 37 located at the bottom end of the intermediate-tray main body 32.

The bunch of sheets P1 stapled on the sheet receiving member 37 at the bottom end of the intermediate-tray main body 32 is moved upward in the storage space V1 by an upward movement of the sheet receiving member 37 caused by the counterclockwise circulating movement of the endless belt 36 via the drive roller 352 and the driven rollers 353 by driving the motor 35. Thereafter, the bunch of sheets P1 is discharged onto the main tray 14 via the main-tray conveyance path R4. After the bunch of sheets P1 is discharged, the sheet receiving member 37 is returned to a predetermined position in the storage space V1 to receive the next sheet P by driving the motor 35 in reverse direction.

It should be noted that unillustrated alignment means is provided in the intermediate tray 30. This alignment means aligns the bunch of sheets P1 by aligning the bunch of sheets P1 introduced into the storage space V1 and the supported on the sheet receiving member 37 with respect to width direction. The detail of this alignment means is not described.

The detour tray 40 includes a detour-tray main body 42, a cover plate 43, a directing guide 44, a pressing member 45 and a pair of valve rollers 46. The detour-tray main body 42 is mounted between a pair of second frame plates 41 while being opposed to the intermediate-tray main body 32, and defines the storage space V1 in cooperation with the intermediate-tray main body 32 while being set in the closing posture S1. The cover plate 43 is so mounted between the second frame plates 41 as to face the upper surface of the detour-tray main body 42. The directing guide 44 is disposed at a position slightly above the upper end of the cover plate 43 to direct the sheet P conveyed from the entrance conveyance path R1 to the storage space V1 or to a standby space V2. The pressing member 45 is disposed in the vicinity of the upper end position of the cover plate 43 to press the sheet P conveyed from the entrance conveyance path R1 toward the directing guide 44. The pair of valve rollers 46 convey the sheet P downward by being driven while temporarily storing the sheets P fed to the standby space V2 from the entrance conveyance path R1.

The length of the detour-tray main body 42 is set to be shorter so that the bottom end thereof is located substantially in the vertical center of the intermediate-tray main body 32, whereas the length of the cover plate 43 is set to be longer so that the bottom end thereof is located at a position slightly above the coupling shaft 33. By setting these lengths in this way, the sheet P conveyed downward from the standby space V2 by driving the pair of valve rollers 46 is guided to a lower side of the cover plate 43 to be securely received by the sheet receiving member 37.

A pair of receiving rollers 131 for receiving the sheet P from the sheet receiving opening 13 are disposed at the upstream end of the entrance conveyance path R1, whereas a pair of feed rollers 132 for feeding the sheet P to a downstream side are disposed at the downstream end thereof. The sheet P is fed by the feed rollers 132 to either the auxiliary-tray conveyance path R2 or the storage-space conveyance path R3 depending on the set posture of the switching guide 17.

In FIG. 5, a state of the switching guide 17 set to such a posture as to direct the sheet P to the storage-space conveyance path R3 is shown in solid line, whereas a state of the switching guide 17 set to such a posture as to direct the sheet P to the auxiliary-tray conveyance path R2 is shown in chain double-dashed line.

A pair of introducing rollers 133 are disposed at the downstream end of the storage-space conveyance path R3. These introducing rollers 133 are disposed to face the upper part of the detour-tray main body 42, thereby introducing the sheet P from the entrance conveyance path R1 to the upper part of the staple tray 20.

The length of the detour-tray main body 42 is set such t h at the upper edge thereof is located at a position substantially right below the introducing rollers 133 via the directing guide 44 and the bottom edge thereof is located substantially in the vertical center of the intermediate-tray main body 32. On the other hand, the cover plate 43 is dimensioned and shaped such that the upper edge thereof is substantially at the same height as the upper edge of the detour-detour-tray main body 42, the bottom edge thereof is located at a position lower than that of the detour-tray main body 42, and the sheet P can be introduced onto the intermediate-tray main body 32. The standby space V2 for keeping the detoured sheet P temporarily waited on standby is defined at a position above the pair of valve rollers 46 between the detour-tray main body 42 and the cover plate 43.

The directing guide 44 has the bottom end thereof rotatably supported on a first mounting shaft 441 extending between the pair of second frame plates 41 and is displaceable between a direct posture T1 shown in solid line in FIG. 5 and a detour posture T2 shown in chain double-dashed line in FIG. 5. Accordingly, with the directing guide 44 set in the direct posture T1, the sheet P fed from the pair of introducing rollers 133 to the directing guide 44 is directed to the storage space V1 while being guided by the left surface of the directing guide 44. On the other hand, with the directing guide 44 set in the detour posture T2, the sheet P fed from the pair of introducing rollers 133 to the directing guide 44 is directed to the standby space V2 while being guided by the right surface of the directing guide 44.

The pressing member 45 is for preventing an occurrence of such a problem as to disorder page numbers caused by a succeeding sheet P slipping under a preceding sheet P in the case where the succeeding sheet P is supplied to be superimposed on on the sheet P already kept on standby in the standby space V2 with the directing guide 44 set in the detour posture T2. The pressing member 45 is constructed such that the succeeding sheet P can be introduced into the standby space V2 after the sheet P already kept on standby in the standby space V2 is lightly pressed toward the pressing member 45. In this way, an occurrence of a page number disorder in the standby space V2 can be prevented.

Figure 6:
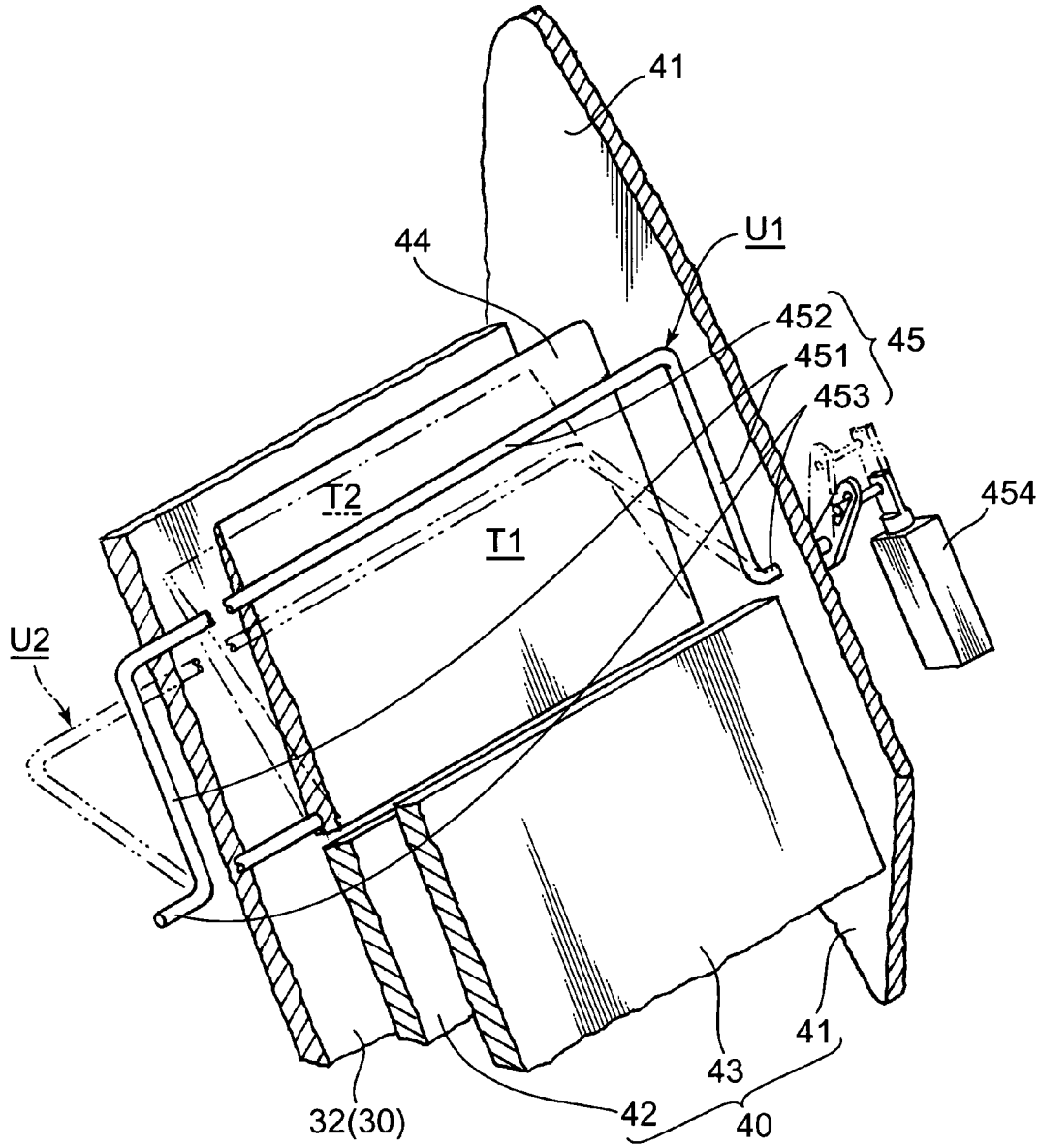
FIG. 6 is a perspective view showing one embodiment of a pressing member.

FIG. 6 is a perspective view showing one embodiment of the pressing member 45. As shown in FIG. 6, the pressing member 45 is formed by bending a metal bar having a specified diameter in U-shape, and includes a pair of arm portions 451, a pressing portion 452 extending between the leading ends of the arm portions 451, and a pair of shaft portions 453 projecting in opposite directions from the respective base ends of the arm portions 451. The respective shaft portions 453 are supported on the second frame plates 41 at positions near the upper edge of the cover plate 43 by being caused to penetrate the second frame plates 41. Thus, the pressing member 45 is rotatable in forward and reverse directions about the shaft portions 453.

The pressing member 45 is rotated in forward and reverse directions about the shaft portions 453 by driving one shaft portion 453 by means of a specified actuator 454 having, for example, a solenoid built therein. By this rotation, the pressing member 45 is displaceable between an opening posture U1 (shown in solid line in FIG. 6) in which the pressing portion 452 is distanced from the directing guide 44 and a pressing posture U2 (shown in chain double-dashed line in FIG. 6) in which the pressing portion 452 presses the sheet P toward the directing guide 44.

The pressing member 45 is set in the opening posture U1 when the first sheet P is introduced into the standby space V2. After the first sheet P is introduced into the standby space V2, the pressing member 45 is rotated about the shaft portions 453 in counterclockwise direction of FIG. 6 to bring the pressing portion 452 toward the front surface of the directing guide 44, thereby being set to the pressing posture U2 to press the first sheet P already supplied onto the detour-tray main body 42. Accordingly, the second sheet P subsequently supplied toward the detour-tray main body 42 next passes between the pair of arm portions 451. This can securely prevent the second sheet P from slipping under the first sheet P already present on the directing guide 44.

When the third sheet P is subsequently introduced into the standby space V2, the preceding two sheets P are temporarily lowered by driving the pair of valve rollers 46 to separate the second sheet P from the pressing portion 452, and are moved upward beyond the pressing portion 452 by driving the pair of valve rollers 46 in reverse direction after the pressing member 45 is returned to the opening posture U1 by being driven by the actuator 454 in this state. After the two sheets P moved upward are pressed by the pressing portion 452, the third sheet P is introduced to the standby space V2 while passing between the pair of arm portions 451. This can securely prevent such a page number disorder that the third sheet P slips under the preceding two sheets P or thrusts itself between the preceding two sheets P.

Thereafter, every time a succeeding sheet P is introduced into the standby space V2, the elevating and lowering movements of the sheet(s) P already stored in the standby space V2 and the change of the posture of the pressing member 45 are repeated while being synchronized as described above. In this way, a specified number of sheets P free from the page number disorder are kept on standby in the standby space V2 until stapling to the preceding bunch of sheets P1 is completed. Upon the completion of stapling to the preceding bunch of sheets P1, the bunch of sheets P1 kept on standby in the standby space V2 is introduced into the storage space V1 by driving the pair of valve rollers 46 to be stapled.

In this embodiment, the sheets P introduced into the storage space V1 by way of the detour space V2 are sheets of A4 or B5 size longitudinally conveyed (such a way of conveyance that the edges of the sheets P along the shorter sides are in parallel with a conveying direction). Contrary to this, sheets P of A4, B5, A3 and B4 sizes laterally conveyed (such a way of conveyance conveyance that the edges of the sheets P along the longer sides are in parallel with the conveying direction) are directly introduced into the storage space V1 without by way of the standby space V2 by setting the directing guide 44 to the direct posture T1.

As described in detail above, the post-processing apparatus 10 according to this embodiment is for discharging the sheets P supplied from the image forming apparatus 19 after applying a specified post-processing, and the staple tray 20 comprised of the intermediate tray 30 for applying the specified post-processing to the bunch of sheets P1 and discharging it after a specified number of sheets P supplied from the image forming apparatus 19 are stored one over another, and the detour tray 40 for directing the sheets P supplied from the image forming apparatus 19 toward the intermediate tray 30 after detouring the sheets P is provided in the post-processing apparatus 10. The staple tray 20 is constructed to be insertable into and withdrawable from the post-processing apparatus 10 along the sheet width direction intersecting with the sheet conveying direction.

With such a construction, the sheet P supplied from the image forming apparatus 19 to the post-processing apparatus 10 is fed to the intermediate tray 30 directly or by way of the detour tray 40, and a specified number of sheets p are stored one over another in the intermediate tray 30. The specified post-post-processing is applied to the bunch of sheets P1 formed by this storage and then the processed bunch of sheets P1 is discharged to the outside.

In this way, the sheets P fed to the intermediate tray 30 in order to apply the specified post-processing to the bunch of sheets P1 stored in the intermediate tray 30 are fed to the intermediate tray 30 directly or by way of the detour tray 40. Thus, the volume of the post-processing apparatus 10 can be reduced as compared to a conventional case where a large standby drum is disposed at an upper position in the post-processing apparatus 10 and sheets P are fed to the intermediate tray 30 after being kept on standby on the outer circumferential surface of this standby drum. This can contribute to making the post-processing apparatus smaller.

The intermediate tray 30 and the detour tray 40 are integrally insertable into and withdrawable from the post-processing apparatus 10. Thus, the respective trays can be more easily withdrawn as compared to a case where the intermediate tray 30 and the detour tray 40 are individually withdrawn.

Further, the detour tray 40 is openable and closable relative to the intermediate tray 30 in a state withdrawn from the post-processing apparatus 10. Thus, both the upper side of the intermediate tray 30 and the bottom side of the detour tray 40 can be exposed to the outside by opening the detour tray 40 withdrawn by withdrawing the intermediate tray 30 from the post-processing apparatus 10. Therefore, an operator can more easily solve a problem of a paper jam.

Furthermore, the detour tray 40 is constructed to be able to temporarily store a specified number of sheets P supplied from the image forming apparatus 19 before feeding the sheets P to the intermediate tray 30. Thus, conveyance intervals of the sheets P fed from the image forming apparatus can be kept constant by supplying the sheets P kept on standby to the intermediate tray 30 after the stapled bunch of sheets P1 is discharged. This can make the image forming operation including the post-processing more efficient.

The present invention is not limited to the foregoing embodiment and also embraces the following contents.

In the foregoing embodiment, the pressing member 45 is disposed at the upper position of the standby space V2 to prevent the page number disorder of the sheets P. However, the page number disorder in the standby space V2 can also be prevented without particularly providing the pressing member 45 by suitably setting the position where the sheet P is directed from the auxiliary-tray conveyance path R2 toward the standby space V2 (specifically, the succeeding sheet P is fed toward a substantially vertical middle part of the sheet P already present in the standby space V2, for example, by suitably setting the positions of the pair of introducing rollers 133).

It should be noted that the foregoing specific embodiment mainly embraces the invention having the following construction.

A post-processing apparatus according to one aspect of the present invention is for applying a specified post-processing to sheets supplied from an image forming apparatus, and comprises a first tray for applying the specified post-processing to a bunch of sheets after storing a specified number of sheets supplied from the image forming apparatus one over another, and then discharging the processed bunch of sheets, and a second tray for directing the sheets supplied from the image forming apparatus toward the first tray after detouring the sheets, the first and second trays being disposed in a specified apparatus main body. The first and second trays are so constructed as to be integrally insertable into and withdrawable from the apparatus main body.

With such a construction, the sheets supplied from the image forming apparatus to the post-processing apparatus are fed to the first tray directly or by way of the second tray, and the specified post-processing is applied to the bunch of sheets formed by storing a specified number of sheets one over another in the first tray. The bunch of sheets having the specified post-processing applied thereto is discharged to the outside thereafter.

In this way, the sheets to be fed to the first tray to apply the specified processing to the bunch of sheets stored in the first tray are fed to the first tray directly or by way of the second tray. Thus, as compared to a case where a large standby drum is provided at an upper position in the apparatus main body and sheets are directed toward the first tray after being detoured on the outer circumferential surface of the standby drum as before, the apparatus main body can have a smaller volume, thereby contributing to making the post-processing apparatus smaller.

Both first and second trays are constructed to be integrally insertable into and withdrawable from the apparatus main body along a sheet width direction intersecting with a sheet conveying direction. Thus, upon an occurrence of a paper jam in the first or second tray, both trays can be integrally withdrawn by withdrawing either one of the first and second trays from the apparatus main body. Therefore, the respective trays can be more easily withdrawn as compared to a case where the first and second trays are individually withdrawn.

In the above construction, the second tray is preferably constructed to be openable and closable relative to the first tray in a state withdrawn from the apparatus main body.

With such a construction, the respective facing surfaces of the first and second trays are exposed to the outside by opening the second tray withdrawn by withdrawing the first tray from the apparatus main body. Therefore, a jammed sheet can be sheet can be more easily removed.

In any one of the above constructions, the second tray is preferably so constructed as to be able to temporarily store a specified number of sheets supplied from the image forming apparatus before directing them toward the first tray and to convey a plurality of sheets temporarily stored in the second tray in a superimposed manner toward the first tray after the preceding bunch of sheets having the post-processing completed therefor is discharged from the first tray.

With such a construction, the succeeding sheets can be kept on standby in the second tray while the preceding bunch of sheets is temporarily stored and stapled in the first tray. Thus, conveyance intervals of the sheets from the image forming apparatus can be kept constant by feeding the sheets kept on standby to the first tray after the previous bunch of sheets having stapling completed therefor is discharged, thereby making the image forming operation including the post-processing more efficient.

This application is based on patent application No. 2005-215872 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the the appended claims rather than by the description preceding them, and all changes that fall within metes and bounds of the claims, or equivalence of such metes and bounds are therefore intended to embraced by the claims.

What is claimed is:

1. A post-processing apparatus for applying a specified post-processing to sheets supplied from an image forming apparatus, comprising:

an apparatus main body, a first tray disposed in the apparatus main body for applying the specified post-processing to a bunch of sheets formed by storing a specified number of sheets supplied from the image forming apparatus one over another, and then discharging the processed bunch of sheets, and a second tray disposed in the apparatus main body for directing the sheets supplied from the image forming apparatus toward the first tray after detouring the sheets, the first and second trays being integrally insertable into and withdrawable from the apparatus main body, the second tray being openable and closable relative to the first tray in a state withdrawn from the apparatus main body.

2. A post-processing apparatus according to claim 1, wherein the second tray temporarily stores a specified number of sheets supplied from the image forming apparatus before directing the sheets toward the first tray, and conveys a specified number of sheets temporarily stored in the second tray in a superimposed state toward the first tray after a preceding bunch of sheets having the post-processing completed therefor is discharged from the first tray.

3. A post-processing apparatus according to claim 1, wherein the specified post-processing is stapling for binding the bunch of sheets by means of a staple.

4. A post-processing apparatus according to claim 1, further comprising:

a staple tray for applying stapling to bind the bunch of sheets by means of a staple, the staple tray including:

a stapler, an intermediate tray serving as the first tray, a detour tray serving as the second tray and mounted on the intermediate tray in such a manner as to extend along a sheet storing surface of the intermediate tray, and a directing guide for guiding the sheet supplied from the image forming apparatus to either the intermediate tray or the detour tray.

5. A post-processing apparatus for applying a specified post-processing to sheets supplied from an image forming apparatus, comprising:

an apparatus main body, and a staple tray insertable into and withdrawable from the apparatus main body, the staple tray including an intermediate tray with a pair of frame plates and an intermediate-tray main body obliquely extending between these frame plates, a detour tray mounted on the intermediate tray to extend along a sheet storing surface of the intermediate tray, the detour tray includes a detour-tray main body opposed to the intermediate-tray main body and a cover plate opposed an upper surface of the detour-tray main body, a storage space defined between the intermediate-tray main body and the detour-tray main body for storing a specified number of sheets supplied from the image forming apparatus one over another to define a bunch of sheets for stapling and then discharging, a standby space for keeping the sheets on standby is defined between the detour-tray main body and the cover plate, a directing guide for guiding the sheets either to the storage space or to the standby space and a stapler for applying stapling to bind the bunch of sheets by means of a staple.

6. A post-processing apparatus according to claim 5, wherein the detour tray has a bottom end portion thereof coupled to the intermediate tray rotatably in forward and reverse directions by means of a coupling shaft and is shiftable between a closing posture to close the intermediate-tray main body and an opening posture to open the intermediate-tray main body.

7. A post-processing apparatus according to claim 4, further comprising:

a fixed rail provided on the inner surface of a side plate forming the apparatus main body, a movable rail provided on the intermediate tray and opposed to the fixed rail, and a retainer disposed between the fixed rail and the movable rail.

* * * * *